US005730365A

United States Patent [19]

Messinger

[11] Patent Number: 5,730,365

[45] Date of Patent: Mar. 24, 1998

[54] ROTARY WATER SPRINKLER INCLUDING PROTECTIVE COVER

[75] Inventor: Daniel Messinger, Migdal Haemek, Israel

[73] Assignee: Plastro Gvat, Doar Gvat, Israel

[21] Appl. No.: 545,131

[22] Filed: Oct. 19, 1995

[30] Foreign Application Priority Data

Oct. 24, 1994 [IL] Israel ..... 111371

[51] Int. Cl.[6] ..... B05B 1/32; B05B 3/04

[52] U.S. Cl. ..... 239/222.17; 239/453

[58] Field of Search ..... 239/222.11, 222.17, 239/222.21, 225.1, 232, 261, 264, 381, 382, 383, 453

[56] References Cited

U.S. PATENT DOCUMENTS 4,796,811 1/1989 Davisson ..... 239/222.17
5,058,806 10/1991 Rupar ..... 239/222.17 X
5,152,458 10/1992 Curtis ..... 239/222.17
5,232,157 8/1993 Laffrey ..... 239/222.17

FOREIGN PATENT DOCUMENTS 890714 10/1942 France .
1277114 1/1961 France .

*Primary Examiner*—Andres Kashnikow
*Assistant Examiner*—Robin O. Evans
*Attorney, Agent, or Firm*—Benjamin J. Barish

[57] ABSTRACT

A rotary sprinkler includes a rotor rotatably mounted with respect to a nozzle to be impinged and to be rotated by the water jet from the nozzle, and a sleeve circumscribing the nozzle and formed with an open end through which the water jet is discharged laterally of the nozzle. The rotor is displaceable axially of the nozzle. A spring normally urges a closure-surface of the rotor against the open end of the sleeve to close it against the entry of foreign matter, but is deformable by the water jet to displace the closure surface of the rotor axially away from the sleeve.

19 Claims, 2 Drawing Sheets

FIG. 1
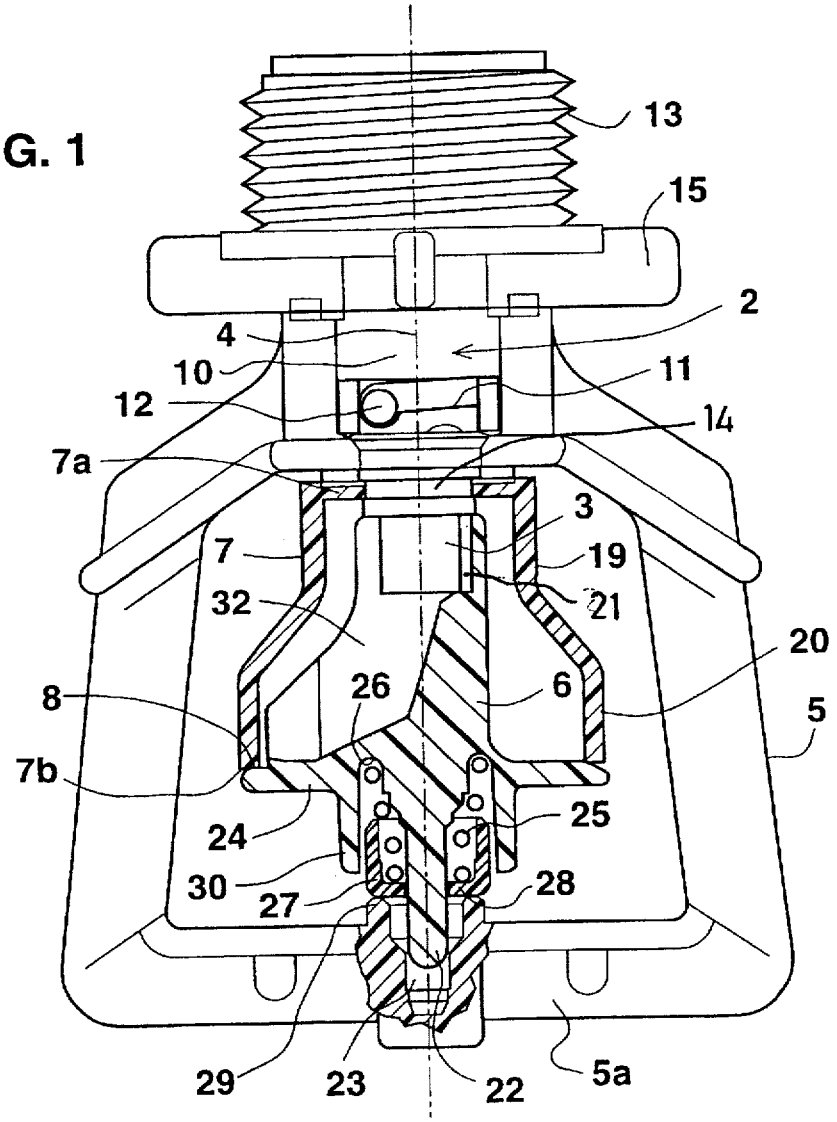
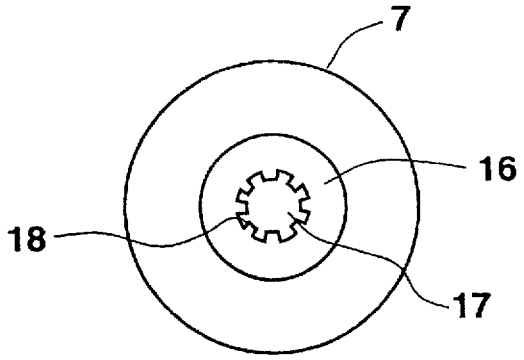
FIG. 2

ROTARY WATER SPRINKLER INCLUDING PROTECTIVE COVER

FIELD AND BACKGROUND OF THE INVENTION

The present invention relates to rotary water sprinklers such as are used for irrigating crops. The invention is particularly directed to a rotary water sprinkler which includes a protective cover to protect the sprinkler from entry of insects, such as ants, or other foreign objects during non-operating periods of the water sprinkler.

Water irrigation sprinklers are frequently left in the field for long periods of non-use. During such periods, ants or other insects attracted by moisture within the sprinkler tend to clog them. Such clogging of the sprinklers by insects, or by the accumulation of other foreign objects, may result in the malfunction, or at least in the need for frequent cleaning, of the sprinklers. This problem has been substantially solved in rotary sprinklers operating in an upright position (i.e., wherein the water jet is discharged from the nozzle in the upward direction, and the rotary deflector is over the nozzle) by mounting the rotary deflector such as to permit it to drop by gravity to cover the discharge outlet when the sprinkler is not in use. However, insofar as we are aware, this problem has not been satisfactorily solved with respect to rotary sprinklers operating in an inverted position, i.e., wherein the water jet is discharged from the nozzle in the downward direction.

OBJECTS AND BRIEF SUMMARY OF THE INVENTION

An object of the present invention is to provide a rotary sprinkler of the inverted type with protection against the entry of insects or other foreign objects during long periods of non-use. While the invention is particularly useful for sprinklers of the inverted type, it may also be used for sprinklers of the upright type.

According to the present invention, there is provided a rotary sprinkler, comprising a nozzle connectible to a source of pressurized water for producing a water jet; a rotor rotatably mounted with respect to the nozzle to be impinged and to be rotated by the water jet and to discharge the water laterally of the sprinkler; the rotor including a rotor bearing surface engageable with a fixed bearing surface fixed with respect to the nozzle; and a sleeve circumscribing the nozzle and formed with an open end through which the water jet is discharged laterally of the nozzle. The rotor is displaceable axially with respect to the nozzle and includes a closure surface engageable with the open end of the sleeve to close the open end. A spring normally urges the rotor to move the closure-surface of the rotor against the open end of the sleeve to close it against the entry of foreign matter, and to move the rotor bearing surface out of engagement with the fixed bearing surface. The spring is deformable to permit the water jet produced by the nozzle to displace the rotor axially away from the sleeve to a displaced position wherein the rotor bearing surface engages the fixed bearing surface to support the rotor during its rotation, and wherein the closure surface opens the open end of the sleeve to permit the rotor to discharge the water laterally of the sprinkler.

As will be described more particularly below, such a rotary sprinkler, whether used in the inverted position or in the upright position, provides protection against the entry of insects or other foreign objects during long periods of non-use.

Further features and advantages of the invention will be apparent from the description below.

BRIEF DESCRIPTION OF THE DRAWINGS

The invention is herein described, by way of example only, with reference to the accompanying drawings, wherein:

FIG. 1 is a side elevational view, partly in section, illustrating one form of rotary sprinkler constructed in accordance with the present invention, the sprinkler being shown in its normal non-operative condition;

FIG. 2 is an end elevational view of a sleeve included in the rotary sprinkler of FIG. 1;

DESCRIPTION OF A PREFERRED EMBODIMENT

Figure 3:
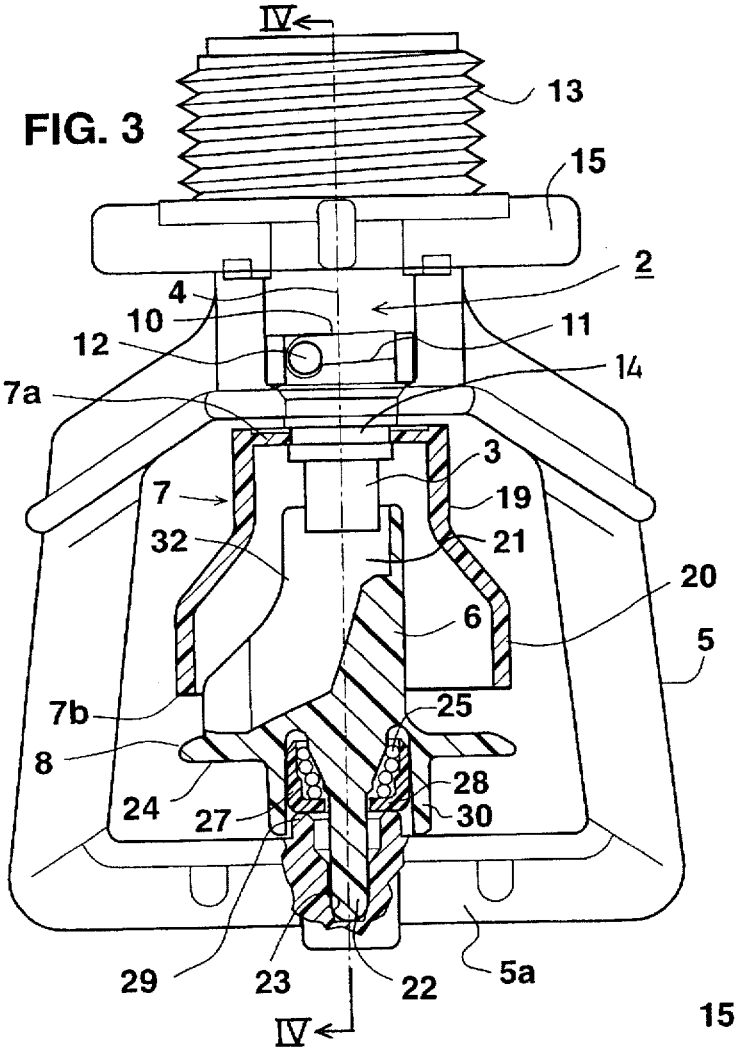
FIG. 3 is a view similar to that of FIG. 1 but showing the sprinkler in its operative condition when distributing water.

The rotary sprinkler illustrated in the drawings comprises a body member, generally designated 2, carrying a nozzle 3 connectible to a source of pressurized water for producing a water jet along the longitudinal axis 4 of the sprinkler. Body member 2 is integrally formed with a bridge 5. A rotor 6 is rotatably mounted between nozzle 3 and leg 5*a* of bridge 5 in alignment with nozzle 3 so as to be impinged by the water jet from the nozzle, and to be rotated by the water jet to distribute the water laterally around the sprinkler. A sleeve 7 is attached at one end 7*a* to nozzle 3, and is open at its opposite end 7*b* through which the water is discharged by the rotor 6 during the operation of the sprinkler.

Rotor 6 is not only rotatable with respect to nozzle 3, but is also axially displaceable with respect to the nozzle. Rotor 6 includes a closure surface 8 which, in the non-operative (normal) condition of the sprinkler (i.e., when its nozzle 3 does not receive pressurized water), is urged towards the open end 7*b* of sleeve 7 so as to close that open end (FIG. 1) and thereby to block the entry of foreign matter, particularly ants and other insects attracted towards the nozzle by the water remaining in the nozzle after use. However, when the sprinkler becomes operative, i.e., pressurized water is applied to its nozzle, the rotor 6 is displaced axially of the nozzle to cause its closure surface to open end 7*b* of sleeve 7 (FIG. 3) and thereby to permit the water to be discharged laterally of the nozzle.

More particularly, body member 2 includes a cylindrical socket 10 integral with bridge 5. The opposed side walls of socket 10 are formed with a bayonet slot 11, and the nozzle 3 includes a pair of bayonet pins 12 received within slots 11 for detachably securing the nozzle to the body member 2. An externally-threaded connector 13 connects the nozzle to a source of pressurized water. The outer surface of nozzle 3 is formed with an annular groove 14 for securing sleeve 7 with a snap-fit.

Nozzle 3 may thus be attached to body member 2 by inserting the nozzle through socket 10 of the body member to align the pins 12 of the nozzle with the bayonet slots 11 in the body member, and then slightly rotating the nozzle to fix the pins 12 within the bayonet slots. Nozzle 3 is provided with a plurality of radially-extending ribs 15 to facilitate manual rotation of the nozzle when attaching it to body member 2.

As shown in FIG. 2, end 7*a* of sleeve 7 includes an end wall 76 formed with a central opening 77 for attaching the sleeve with a snap-fit to nozzle 3. For this purpose, sleeve end wall 16 is formed with a plurality of radially-extending tabs or projections 18 circumferentially-spaced around opening 17 to provide some elasticity to the edge of opening 17 and thereby to permit that edge to be received within annular groove 14 of nozzle 3 with a snap-fit.

Sleeve 7 includes a small-diameter section 19 adjacent to its end 7*a* and circumscribing nozzle 3. Sleeve 7 further includes a large-diameter section 20 at its opposite, open end 7*b*projecting towards leg 5*a* of bridge 5 and normally enclosing the rotor 6.

As indicated above, rotor 6 is mounted for both rotary movement and axial movement between nozzle 3 and leg 5*a* of the bridge 5. For this purpose, one end of rotor 6 is formed with a cavity 21 to enclose the end of nozzle 3. The opposite end of the rotor is formed with an axially-extending pin 22 to be received within a recess 23 formed in leg 5*a* of the bridge 5. As will be described below, during the operation of the sprinkler, pin 22, serving as a rotor bearing surface, engages recess 23, serving as a fixed bearing surface, to support the rotor during its rotation with respect to the nozzle 3.

The previously mentioned closure surface 8 of the rotor is the outer edge of a flat annular section 24 of the rotor circumscribing pin 22. Annular section 24 has an outer diameter equal to that of the open end 7*b* of sleeve 7 so as to close the sleeve during the normal, non-operative condition of the sprinkler, as shown in FIG. 1. Rotor 6 is urged to this sleeve-closing position by a spring 25 received within an annular groove 26 circumscribing pin 22, and a cap 27 having an end wall 28 formed with an aperture for accommodating the rotor pin 22.

Bridge leg 5*a* is further formed with an annular rib 29 circumscribing its recess 23. Rotor 6 is formed with an annular wall 30 circumscribing its pin 22 and of larger diameter than annular rib 29 of bridge leg 5*a* so as to enclose that rib in the operative position of the sprinkler as illustrated in FIG. 3.

The outer surface of rotor 6 is formed with an axially-extending groove 32 starting from its cavity 21 and extending to the inner edge of the annular section 24 of the rotor. Groove 32 receives the water jet discharged from nozzle 3 and is effective to rotate the rotor, and also to deflect the water jet so that the water jet is discharged laterally of the sprinkler as the rotor rotates to distribute the water around the sprinkler.

The water sprinkler illustrated in the drawings operates as follows:

FIG. 1 illustrates the sprinkler in its normal, non-operative condition, i.e., when not receiving pressurized water. In this condition of the sprinkler, spring 25 interposed between rotor 6 and cap 27 engaged by annular rib 29 of the bridge leg 5*a*, urges the rotor away from bridge 5 and towards nozzle 3 such that the outer edge of the annular section 24 of the rotor closes the open end 7*b* of sleeve 7. It will thus be seen that in this non-operative condition of the sprinkler, section 24 of the rotor blocks the entry of ants or other foreign matter which may tend to clog the nozzle 3.

Figure 4:
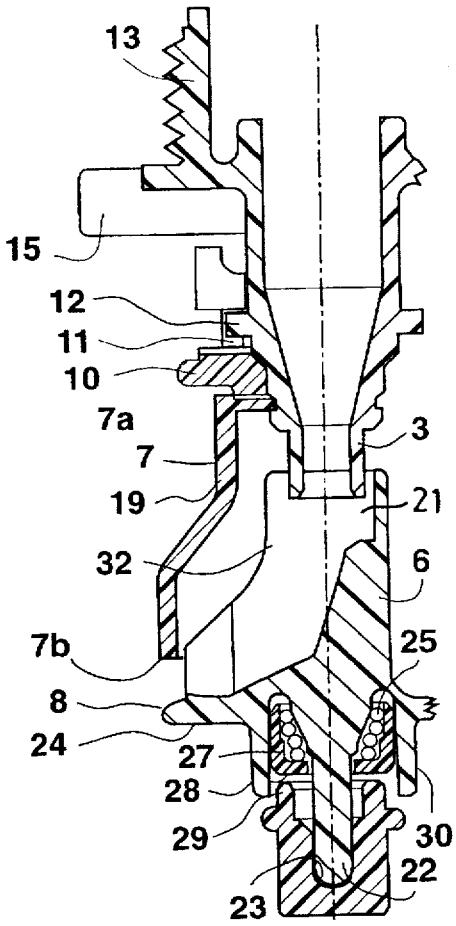
FIG. 4 is a partial longitudinal sectional view along line IV—IV of FIG. 3.

When pressurized water is applied to nozzle 3 via its connector 13, the nozzle produces a water jet which first impinges the surface within cavity 21 of rotor 6 and is then directed by groove 32 of the rotor towards the outer end of rotor section 24. The water jet first moves the rotor in the axial direction until its pin 22 seats against the bottom of recess 23 in bridge leg 5*a*, which thereby moves rotor section 24 towards bridge leg 5*a* and away from the open end 7*b* of sleeve 7, as shown in FIGS. 3 and 4. The water jet passing through groove 32 also rotates the rotor 6 so that the water jet exiting in the space between rotor section 24 and the open end 7*b* of sleeve 7 is rotated about axis 4 of the sprinkler to thereby discharge the water laterally around the sprinkler.

Rotor pin 22 is so dimensioned that, in the operative condition of the sprinkler wherein pin 22 seats against the bottom of recess 23 in bridge leg 5*a*, the pin slightly spaces the outer edge of annular rib 30 of the rotor from the adjacent surface of bridge leg 5*a*, thereby minimizing the friction between the rotating rotor 6 and the fixed bridge leg 5*a*. Some friction does occur, however, between the annular rib 29 of bridge leg 5*a* and wall 28 of cap 27 rotating with rotor 6, but this friction is relatively small because spring 25, which urges the cap against annular rib 29, is a very light spring; it is of sufficient force only to move the rotor 6 to its closed position with respect to sleeve 7 in the normal, non-operative condition of the sprinkler.

It will thus be seen that the sprinkler illustrated in the drawings blocks entry of ants and other foreign matter during the non-operative condition of the sprinkler, but automatically opens to discharge water as soon as pressurized water is applied to the sprinkler.

While the invention has been described with respect to one preferred embodiment, it will be appreciated that many variations and other applications may be made. For example, the sprinkler illustrated in the drawings could also be used in the upright position, i.e., with the water jet issuing from the nozzle 3 in the upward direction, rather than in the downward direction as illustrated in the drawings. Many other variations, modifications and applications of the invention will be apparent.

I claim:

1. A rotary sprinkler, comprising:

a nozzle connectible to a source of pressurized water for producing a water jet;

a rotor rotatably mounted with respect to said nozzle to be impinged and to be rotated by said water jet and to discharge the water laterally of the sprinkler;

said rotor including a rotor bearing surface engageable with a fixed bearing surface fixed with respect to said nozzle;

a sleeve circumscribing said nozzle and formed with an open end through which said water jet is discharged laterally of the nozzle;

said rotor being displaceable axially with respect to said nozzle and including a closure surface engageable with the open end of the sleeve to close said open end;

and a spring normally urging said rotor to move said closure-surface of the rotor against the open end of the sleeve to close it against the entry of foreign matter and to move said rotor bearing surface out of engagement with said fixed bearing surface;

said spring being deformable to permit the water jet produced by the nozzle to displace the rotor axially away from said sleeve to a displaced position wherein said rotor bearing surface engages said fixed bearing surface to support the rotor during its rotation, and said closure surface opens said open end of the sleeve to permit the rotor to discharge the water laterally of the sprinkler.

2. The rotary sprinkler according to claim 1, wherein said rotor bearing surface is a pin, and said fixed bearing surface is a recess formed in a bridge fixed with respect to the nozzle.

3. The rotary sprinkler according to claim 2, wherein said spring is interposed between the rotor and a cap formed with an aperture receiving said pin of the rotor.

4. The rotary sprinkler according to claim 3, wherein said bridge is formed with an annular rib circumscribing said recess and engageable with said cap.

5. The rotary sprinkler according to claim 4, wherein said rotor includes an annular wall coaxial with, but of larger diameter than, said rotor pin to enclose said cap and the annular rib of the bridge in said displaced position of the rotor.

6. The rotary sprinkler according to claim 5, wherein the length of said rotor pin is such as to slightly space the annular wall of the rotor from the surface of the bridge in the displaced position of the rotor.

7. The rotary sprinkler according to claim 2, wherein said sleeve includes a first section enclosing and fixed to said nozzle, and a second section of larger diameter than said first section and projecting axially of said nozzle towards the rotor, said second section being formed with said open end normally closed by said closure surface of the rotor.

8. The rotary sprinkler according to claim 7, wherein said closure surface of the rotor is the outer edge of an annular section of the rotor circumscribing said pin.

9. The rotary sprinkler according to claim 8, wherein the end of said rotor opposite to that formed with said pin and said flat annular surface is formed with a cavity enclosing said nozzle, and with an outwardly grooved formation leading from said cavity to the outer edge of said flat annular surface.

10. A rotary sprinkler, comprising:

a nozzle connectible to a source of pressurized water for producing a water jet;

a rotor rotatably mounted with respect to said nozzle to be impinged and to be rotated by said water jet and to discharge the water laterally of the sprinkler;

a sleeve circumscribing said nozzle and formed with an open end through which said water jet is discharged laterally of the nozzle;

said rotor being displaceable axially with respect to said nozzle and including a closure surface engageable with the open end of the sleeve to close said open end;

and a spring normally urging said closure-surface of the rotor against the open end of the sleeve to close it against the entry of foreign matter, but deformable by the water jet produced by the nozzle to permit the water jet to displace the rotor axially away from said sleeve to a displaced position wherein said closure surface opens said open end of the sleeve and permits the rotor to discharge the water laterally of the sprinkler;

wherein said sleeve is fixed to said nozzle by a plurality of radially-extending projections formed in one end of the sleeve receivable in an annular groove formed in the outer surface of the nozzle.

11. A rotary sprinkler, comprising:

a nozzle connectible to a source of pressurized water for producing a water jet;

a rotor rotatably mounted with respect to said nozzle to be impinged and to be rotated by said water jet and to discharge the water laterally of the sprinkler;

a sleeve including a first section enclosing and fixed to said nozzle, and a second section of larger diameter than said first section and projecting axially of said nozzle towards the rotor, said second section being formed with an open end;

a bridge fixed with respect to said nozzle;

said rotor being displaceable axially with respect to said nozzle and including a closure surface engageable with said open end of the sleeve to close said open end;

and a spring interposed between said rotor and said bridge normally urging said rotor away from said bridge and said closure-surface of the rotor against the open end of the sleeve to close it, but deformable by the water jet produced by the nozzle to permit the water jet to displace the rotor axially towards said bridge and away from said sleeve to open said open end of the sleeve.

12. The rotary sprinkler according to claim 11, wherein said rotor is rotatably mounted with respect to said nozzle by means of a pin formed in the rotor rotatably received within a recess formed in said bridge fixed with respect to the nozzle.

13. The rotary sprinkler according to claim 12, wherein said closure surface of the rotor is the outer edge of an annular section of the rotor circumscribing said pin.

14. The rotary sprinkler according to claim 13, wherein the end of said rotor opposite to that formed with said pin and said flat annular surface is formed with a cavity enclosing said nozzle, and with an outwardly grooved formation leading from said cavity to the outer edge of said flat annular surface.

15. The rotary sprinkler according to claim 11, wherein said sleeve is fixed to said nozzle by a plurality of radially-extending projections formed in one end of the sleeve receivable in an annular groove formed in the outer surface of the nozzle.

16. The rotary sprinkler according to claim 12, wherein said spring is interposed between the rotor and a cap formed with an aperture receiving said pin of the rotor.

17. The rotary sprinkler according to claim 16, wherein said bridge is formed with an annular rib circumscribing said recess and engageable with said cap.

18. The rotary sprinkler according to claim 17, wherein said rotor includes an annular wall coaxial with, but of larger diameter than, said rotor pin to enclose said cap and the annular rib of the bridge in said displaced position of the rotor.

19. The rotary sprinkler according to claim 18, wherein the length of said rotor pin is such as to slightly space the annular wall of the rotor from the surface of the bridge in the displaced position of the rotor.

* * * * *